US006512375B1

(12) United States Patent
Yamada et al.

(10) Patent No.: US 6,512,375 B1
(45) Date of Patent: Jan. 28, 2003

(54) METHOD OF DETECTING SPARK PLUG FOULING AND IGNITION SYSTEM HAVING MEANS FOR CARRYING OUT THE SAME

(75) Inventors: Tatsunori Yamada, Aichi (JP); Yasushi Sakakura, Aichi (JP)

(73) Assignee: NGK Spark Plug.Co., Ltd., Aichi (JP)

( * ) Notice: Subject to any disclaimer, the term of this patent is extended or adjusted under 35 U.S.C. 154(b) by 37 days.

(21) Appl. No.: 09/655,764

(22) Filed: Sep. 5, 2000

(30) Foreign Application Priority Data

Sep. 2, 1999 (JP) ..... 11-248717

(51) Int. Cl.[7] ..... F02P 17/00; H01H 31/02

(52) U.S. Cl. ..... 324/399; 324/388; 324/384; 324/391; 324/395; 324/537

(58) Field of Search ..... 324/399, 395, 324/388, 384, 391, 537; 123/406.66, 406.42

(56) References Cited

U.S. PATENT DOCUMENTS

| | | | | |
|---|---|---|---|---|
| 3,875,912 A | * | 4/1975 | Bullo | 123/117 R |
| 5,143,042 A | * | 9/1992 | Scheid | 123/630 |
| 5,221,904 A | * | 6/1993 | Shimasaki et al. | 324/378 |
| 5,396,176 A | * | 3/1995 | Ishii et al. | 324/388 |
| 6,020,742 A | * | 2/2000 | Kano et al. | 324/399 |
| 6,222,368 B1 | * | 4/2001 | Inagaki et al. | 324/399 |

FOREIGN PATENT DOCUMENTS

| | | |
|---|---|---|
| EP | 0810368 A2 | 12/1997 |
| JP | 526097 | 2/1993 |
| JP | 544624 | 2/1993 |
| JP | 11-13618 | 1/1999 |
| JP | 11-13620 | 1/1999 |
| JP | 11-50941 | 2/1999 |

* cited by examiner

*Primary Examiner*—N. Le
*Assistant Examiner*—Wasseem H. Hamdan
(74) *Attorney, Agent, or Firm*—Sughrue Mion, PLLC

(57) ABSTRACT

A method of detecting spark plug fouling in an internal combustion engine is provided. The method comprises calculating an integration value of discharge current flowing between electrodes of a spark plug during a period of a spark discharge and judging if the calculated discharge current integration value is smaller than an integration value criterion. The integration value criterion is set at such a value that can discriminate between normal discharge and interior jumping (i.e., jumping due to short circuit caused by fouling). When the calculated discharge current integration value is smaller than the integration value criterion, it is judged that the spark plug has been fouled. By this, it becomes possible to detect a spark plug fouling before the electrodes of the spark plug are short-circuited and disabled to generate spark discharge, i.e., before the spark plug is fouled to such an extent as to cause a misfire. An ignition system for detecting spark plug fouling is also provided.

13 Claims, 11 Drawing Sheets

METHOD OF DETECTING SPARK PLUG FOULING AND IGNITION SYSTEM HAVING MEANS FOR CARRYING OUT THE SAME

BACKGROUND OF THE INVENTION

The present invention relates to a method of detecting spark plug fouling in an internal combustion engine. The present invention further relates to an ignition system having means for carrying out such a method.

In an internal combustion engine, an air-fuel mixture introduced into a cylinder is ignited by a spark produced at a spark gap between a center electrode and a ground electrode of a spark plug provided to the cylinder. As shown in FIGS. 12A and 12B, a spark plug 17 includes a metal shell 17*d*, an insulator 17*c* enclosed in the metal shell 17*d*, a center electrode 17*a* insulated by the insulator 17*d* from the metal shell 17*d* and having an end portion protruding from the insulator 17*d*, and a ground electrode 17*b* having an end attached to the metal shell 17*d* and the other end opposed to the end portion of the center electrode 17*a*. Such a spark plug 17 is constructed so that the insulation resistance between the center electrode 17*a* and the ground electrode 17*b* (i.e., the insulation resistance of the portion schematically represented by a voltmeter V in FIGS. 12A and 12B) is sufficiently large.

In such a spark plug 17, there can occur such a case in which when a rich mixture is introduced into a cylinder, the mixture is not combusted completely due to a factor such as incomplete atomization of fuel, and so-called carbon fouling (i.e., deposition of carbon or black soot on the surface of insulator 17*c*) is caused. When the amount of carbon adhered to the surface of the insulator 17*c* becomes large, that is, when the progress of carbon fouling becomes noticeable, the insulation resistance between the electrodes 17*a* and 17*b* of the spark plug 17 becomes smaller, thus possibly causing such a case in which when a high voltage for ignition is applied to the spark plug 17 from an ignition coil (not shown) to produce a spark at the spark gap g, leakage current flows through the deposition of carbon C so that a spark is not produced but a misfire is caused.

Thus, it has been proposed such a spark plug fouling detecting method that utilizes a technique of detecting ion in terms of ion current, which ion is generated when an air-fuel mixture is ignited by a spark plug and combusted, as disclosed in Japanese Patent Provisional Publication Nos. 11-13620 and 11-50941. A leakage current due to spark plug fouling is superimposed on an ion current so that the behavior of current detected by an ion current detecting means (ion current detecting circuit) at the time of generation of ion current (more specifically, the behavior of current after the focusing of ion current) varies depending upon a variation of leakage current which is caused to vary depending upon the progress of spark plug fouling. The method disclosed in the above described publications is adapted to detect the progress of spark plug fouling by monitoring the behavior of the current detected by the ion current detecting means.

SUMMARY OF THE INVENTION

In the meantime, as shown in FIG. 12A, even when spark plug fouling has been caused though the progress in adherence of carbon (black soot) C to the surface of the insulator 17*c* is at a stage prior to causing a short circuit between the electrodes 17*a* and 17*b* of the spark plug 17, there may occur such a case in which a sufficient insulator resistance is still kept between the electrodes 17*a* and 17*b*. In this connection, there may further occur such a case in which when a high voltage for ignition is applied from an ignition coil to the spark plug 17, the high voltage does not jump across the spark gap g to create a spark but the carbon C adhered to the surface of the insulator 17*c* conducts the current delivered to the spark plug 17 (i.e., carbon serves as a discharge path) to cause the high voltage to jump across a gap between an end portion of the carbon layer C and the inner wall surface of the metal shell 17*d* to create a spark which is so-called interior jumping or leak spark to inner shell bore. Although the mixture can be ignited if located adjacent a flame kernel produced by the interior jumping, such a spark by interior jumping is more difficult to be exposed to the mixture as compared with a spark at the spark gap g, thus resulting in a tendency that the combustion efficiency attained by the interior jumping is lower as compared with that attained by the spark at the spark gap g.

However, while the prior art method disclosed in the above described publications is adapted to detect the progress of spark plug fouling, it detects the progress on the basis of leakage current. Generally, the flow of leakage current is caused when the spark plug fouling progresses to such an extent as to cause a short circuit(i.e., carbon is adhered to the surface of an insulator to such an extend as to cause a short circuit between the electrodes of the spark plug) and the insulation resistance between the electrodes is lowered. The method of the above described publications can detect such spark plug fouling that has progressed to such an extend as to cause a short circuit between the electrodes of the spark plug, i.e., such spark plug fouling that is considered to be in a condition of causing misfires in a high probability, but cannot detect such spark plug fouling that has not progressed to such an extent as to cause a short circuit between the electrodes of the spark plug (i.e., the progress of spark plug fouling is at a stage prior to causing a short circuit between the electrodes) but to such an extend as to be capable of causing interior jumping.

It is accordingly an object of the present invention to provide a spark plug fouling detecting method which can detect such spark plug fouling that is causative of interior jumping, and therefore can detect such spark plug fouling at a stage of progress prior to a stage of causing a short circuit between the electrodes of the spark plug.

It is a further object of the present invention to provide an ignition system for an internal combustion engine, which has means for carrying out a spark plug fouling detecting method of the foregoing character.

To accomplish the above object, the present invention provides a method of detecting spark plug fouling in an internal combustion engine. The engine has an ignition system that interrupts flow of primary current through a primary winding of an ignition coil and thereby inducing a high voltage for ignition in a secondary winding of ignition coil and applies the high voltage for ignition to a spark plug. The method comprises detecting a discharge current flowing between electrodes of the spark plug when the high voltage for ignition is applied to the spark plug, and determining a fouled condition of the spark plug on the basis of the discharge current.

In a spark plug provided to a cylinder of an internal combustion engine, a discharge current flows between the electrodes of the spark plug when a high voltage for ignition generated by an ignition coil is applied to the spark plug. It is considered that there are two kinds of discharge produced by the spark plug, i.e., discharge that is produced at the normal spark gap (hereinafter referred to as "normal discharge"), and discharge that is produced due to conduction of current by a layer of carbon adhered to the surface of an insulator of the spark plug, namely, that is produced by so-called interior jumping. In this connection, at the time of interior jumping, the discharge current flows through a discharge path constituted by the layer of carbon adhered to the surface of the insulator and having a relatively large resistance. For this reason, the discharge current flowing between the electrodes of the spark plug at the time of interior jumping, differs in a current value from the discharge current flowing between the electrodes of the spark plug at the time of normal discharge. Thus, by monitoring the discharge current at the time of discharge of the spark plug, it becomes possible to make judgment on whether normal discharge or interior jumping is caused by the spark plug.

The interior jumping is caused at a stage of the progress of fouling prior to the stage in which the electrodes of the spark plug are shorted by adherence of carbon. Thus, by detecting the occurrence of interior jumping, it becomes possible to detect spark plug fouling at a stage of progress prior to a stage in which the electrodes of the spark plug are shorted by adherence of carbon.

The present invention further provides an ignition system for an internal combustion engine comprising an ignition coil having a primary winding and a secondary winding, a spark plug having a pair of electrode and an insulator insulating between the electrodes, and a control unit that interrupts flow of primary current through the primary winding and thereby inducing a high voltage for ignition in the secondary winding, wherein the control unit includes means for detecting a discharge current flowing between the electrodes of the spark plug when the high voltage for ignition is applied to the spark plug, and means for judging if said spark plug has been fouled on the basis of the discharge current.

DESCRIPTION OF THE PREFERRED EMBODIMENTS

Figure 1:
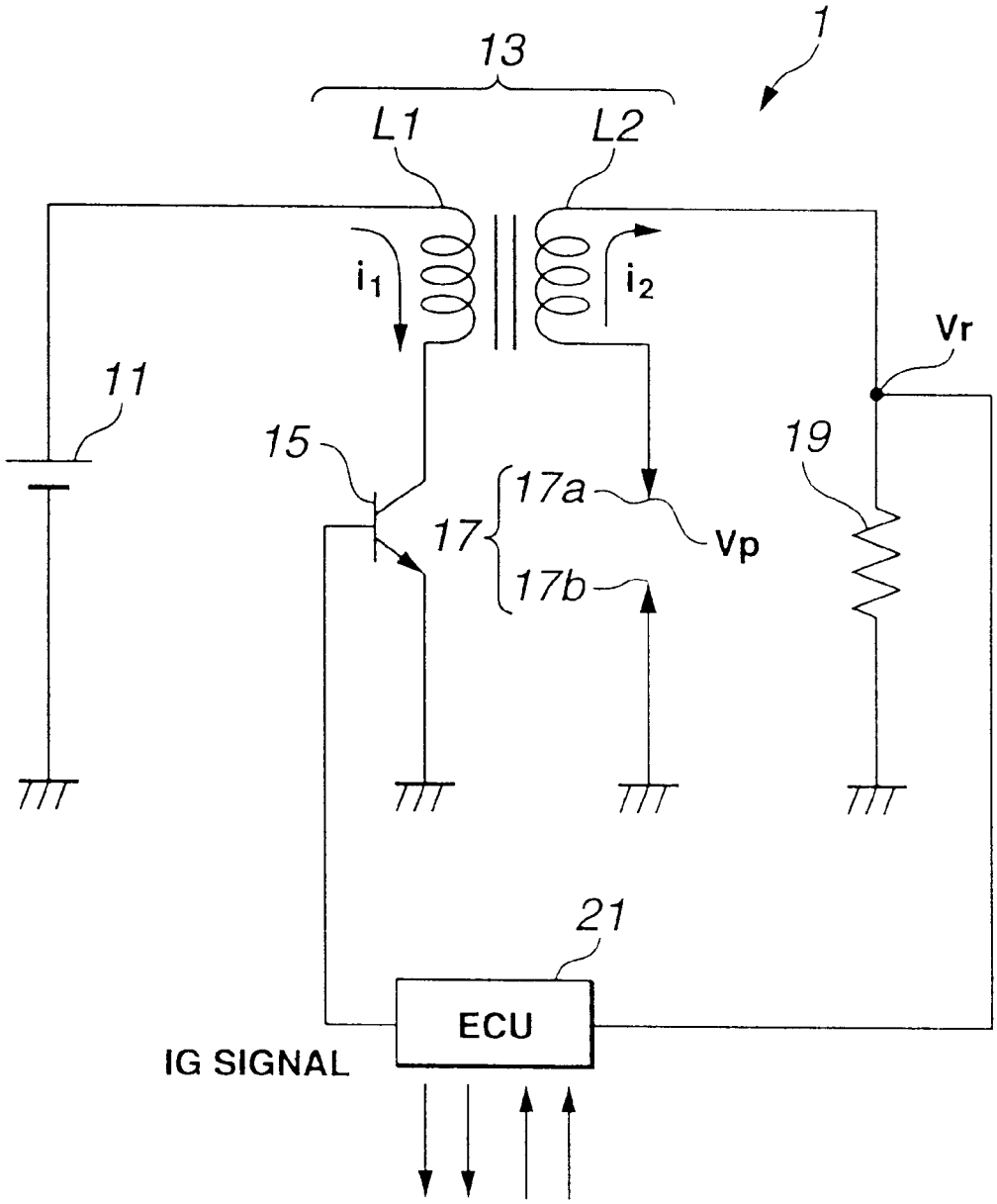
FIG. 1 is a circuit diagram of an ignition system of an internal combustion engine according to a first embodiment of the present invention.

Referring first to FIG. 1, an ignition system for an internal combustion engine according to a first embodiment of the present invention is generally indicated by 1. While the ignition system 1 is provided to each cylinder except for an electronic control unit 21, only a portion thereof provided to one cylinder is shown in FIG. 1 for simplicity of illustration and ease of understanding.

As shown in FIG. 1, the ignition system 1 for an internal combustion engine includes a power unit (battery) 11 for supply of an electric energy for spark discharge (e.g., voltage of 12V), an ignition coil 13 consisting of a primary winding L1 and a secondary winding L2, an npn transistor 15 connected in series with the primary winding L1, a spark plug 17 provided to a cylinder (not shown) of an internal combustion engine, a detection resistor 19 having a resistance value of 100Ω and connected at an end to the secondary winding L2 and grounded at the other end, and an electronic control unit (ECU) 21 which outputs an IG (ignition) signal to the transistor 15 and to which is supplied a voltage Vr across a connecting point of the detection resistor 19 in connection with the secondary winding L2.

The transistor 15 is a switching element made up of a semiconductor element for switching energizing and deenergizing of the primary winding L1 of the ignition coil 13 from one to another. The ignition system 1 of this embodiment is a full transistor type.

In the meantime, the transistor 15 is adapted to serve as an igniter for spark plug ignition, which switches energizing and deenergizing of the primary winding L1 from one to another. For such an igniter can be used, for example, an insulated-gate bipolar transistor (IGBT) other than an npn transistor.

The primary winding L1 is connected at an end to a positive electrode of the power unit 11 and at the other end to a collector of the transistor 15. The secondary winding L2 is connected at an end to the detection resistor 19 as mentioned above and at the other end to a center electrode 17*a* of the spark plug 17. A ground electrode 17*b* of the spark plug 17 is connected to a ground of the same electric potential as that of the negative electrode of the power unit 11. The base of the transistor 15 is connected to the ECU 21 and the emitter of the transistor 15 is grounded.

In case an ignition (IG) signal which is outputted by the ECU 21 and inputted to the transistor 15 for controlling the ignition timing is low in level (generally, of ground potential), base current does not flow through the transistor 15 to put the transistor 15 into a turned-off condition, and therefore there is not any current flowing through the primary winding L1 by way of the transistor 15. Further, in case the IG signal is high in level, the transistor 15 is put into a turned-on condition, and there is formed a conduction path for energizing of primary winding L1, which extends from the positive electrode to the negative electrode of the power unit 11 through the primary winding L1 of the ignition coil 13 and the transistor 15, thus causing primary current i1 to flow through the primary winding L1.

Accordingly, when the IG signal having been high in level to allow primary current i1 to flow through the primary winding L1, changes to low in level, the transistor 15 is turned off to stop supplying (i.e., interrupt supply of) the primary current i1 to the primary winding L1. When this is the case, a high voltage for ignition is generated or induced in the secondary winding L2 of the ignition coil 13 and applied to the spark plug 17, thus causing spark discharge to be generated between the electrodes 17*a* and 17*b* of the spark plug 17.

The ignition coil 13 is constructed so as to generate, on the center electrode 17*a* side of the spark plug 17, a negative high voltage for ignition which is lower than the ground potential when the transistor 15 interrupts an electric current to be supplied to the primary winding L1. By this, the secondary current i2 flowing through the secondary winding L2 at the time of the spark discharge is directed so as to flow from the center electrode 17*a* of the spark plug 17 toward the secondary winding L2 side.

In this instance, since the secondary current i2 is caused to flow further through the detection resistor 19, a potential difference is generated between the opposite ends of the detection resistor 19. An electric potential Vr at an end of the detection resistor 19 in connection with the secondary winding L2 varies depending upon a variation of the secondary current i2. The secondary current i2 varies depending upon a variation of spark plug fouling which is caused by the deposition or adherence of carbon onto the surface of the insulator 17*c* (refer to FIGS. 12A and 12B) holding therewithin the center electrode 17*a* of the spark plug 17.

In order to confirm how the secondary current i2 varies depending upon a variation of spark plug fouling (i.e., adherence of carbon), measurement of the secondary current i2 was made with respect to various kinds of spark discharge, i.e., (a) normal discharge, (b) discharge by a slightly fouled spark plug and (c) discharge by a heavily fouled spark plug. The result of measurement will be described hereinafter.

Figure 12B:
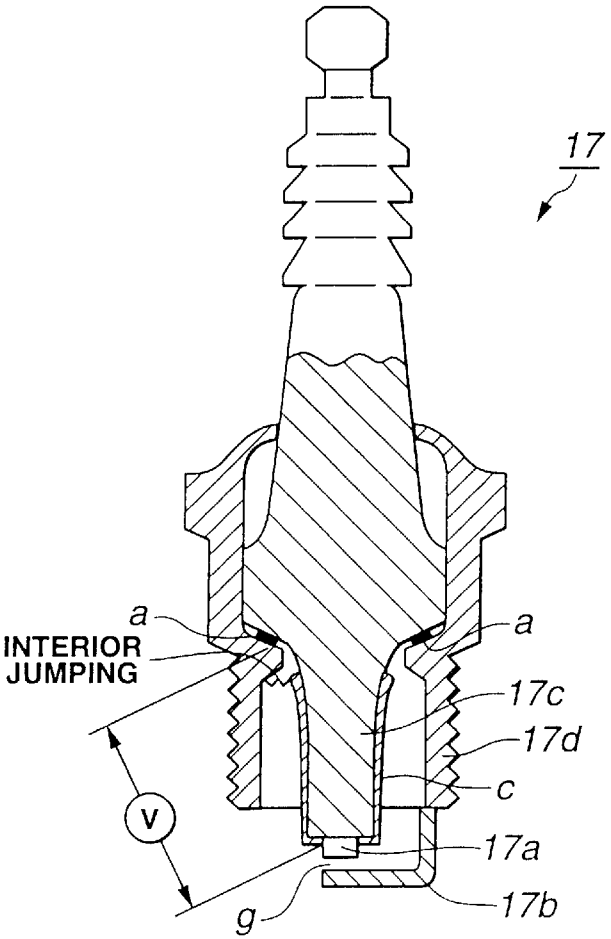
FIGS. 12A and 12B are schematic sectional views of a spark plug for illustration of "interior jumping".
Figure 12A:
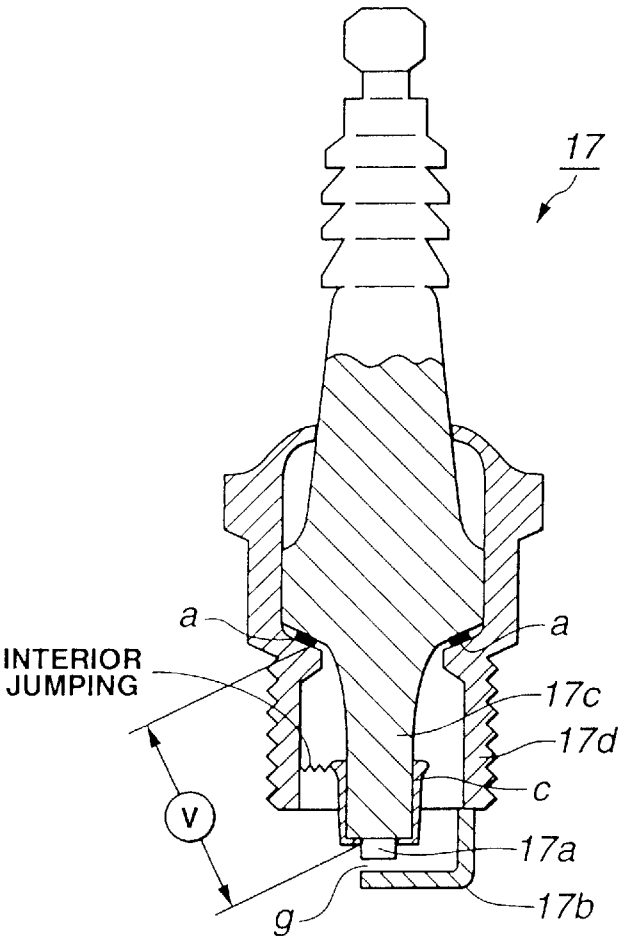

In the meantime, the normal discharge is intended to indicate a spark discharge which is attained by a spark plug 17 in such a condition in which there is not any carbon adhered to the surface of an insulator 17*c* holding therewithin a center electrode 17*a* (i.e., in a condition in which there is not found any spark plug fouling) and which is generated at a proper spark plug gap. The discharge by a slightly fouled spark plug is intended to indicate a spark discharge which is attained by a spark plug in a fouled condition of allowing, as shown in FIG. 12A, carbon C to be adhered to the surface of the insulator 17*c* so as to extend from an end portion on the center electrode 17*a* side to a portion adjacent a point "a" of contact between the insulator 17*c* and the inner wall face of the metal shell 17*d* having fixed thereto the ground electrode 17*b* (actually, both are joined by interposing therebetween a seat packing), i.e., a spark discharge generated between an end of the carbon C and the inner surface of the metal shell 17*d*, namely, so-called interior jumping. Further, the discharge by a heavily fouled spark plug is intended to indicate, as shown in FIG. 12B, a discharge which is attained by a spark plug in a fouled condition in which the spark plug 17 is at a stage of fouling mediately before the stage in which the interval between the electrodes of the spark plug 17 (i.e., the portion schematically indicated by the voltmeter V) is shorted by means of the carbon C adhered to the surface of the insulator 17*c*, namely, intended to indicate interior jumping which is generated at a location more adjacent the point "a" of contact between the insulator 17*c* and the metal shell 17*d* as compared with the interior jumping caused by a slightly fouled spark plug.

Figure 2A:
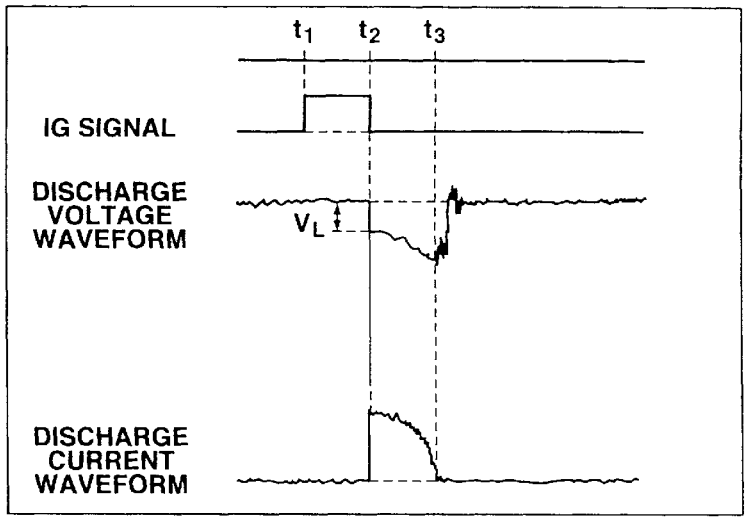
FIGS. 2A to 2C are time charts illustrating discharge under a normal spark plug condition, discharge under a slightly fouled spark plug condition and discharge under a heavily fouled spark plug condition, respectively.
Figure 2B:
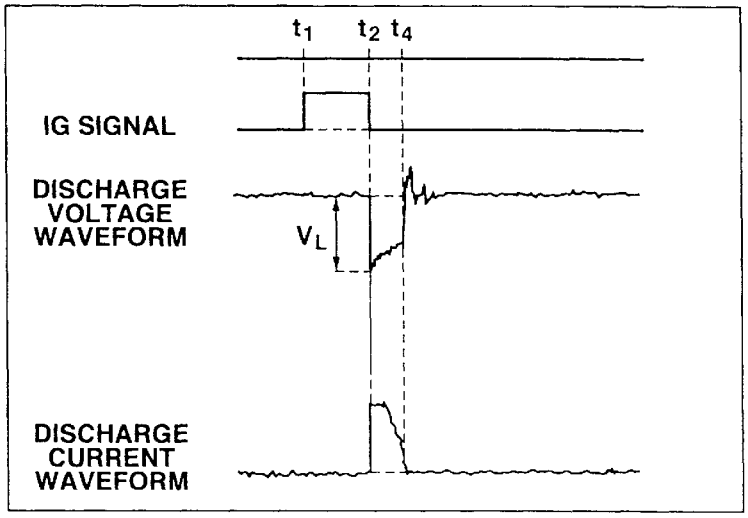
Figure 2C:
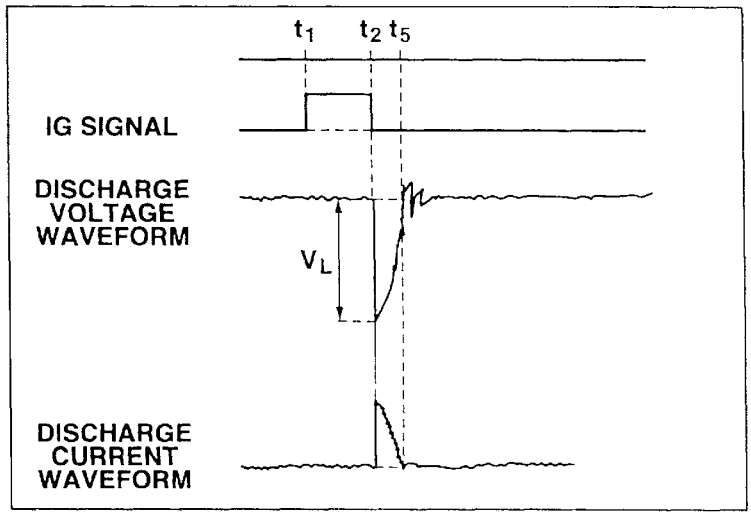

The time charts of FIGS. 2A to 2C show the result of measurement of the IG signal, the electric potential Vp at the center electrode 17*a* of the spark plug 17, and the electric potential Vr (secondary current i2) at a secondary winding L2 side connecting end of the detection resistor 19 in the circuit of FIG. 1. In the meantime, FIGS. 2A to 2C show the result of measurement at the time of (a) normal discharge, (b) discharge by a slightly fouled spark plug and (c) discharge by a heavily fouled spark plug, respectively. Further, in FIGS. 2A to 2C, the electric potential Vp and the electric potential Vr are referred to as discharge voltage waveform and discharge current (secondary current i2) waveform, respectively.

Firstly, in FIG. 2A, at the time t1, the IG signal is changed from low to high in level, and the primary current i1 is supplied to the primary winding L1 of the ignition coil 13. Thereafter, at the time t2 after lapse of a preset energizing time, the IG signal is changed from high to low in level to interrupt supply of the primary current i1 to the primary winding L1 of the ignition coil 13. When this is the case, a high voltage for ignition is induced in the secondary winding L2 and a negative high voltage is applied to the center electrode 17*a* of the spark plug 17. By this, the electric potential Vp at the center electrode 17*a* is abruptly lowered to show a peak value, and a spark discharge is generated between the electrodes 17*a* and 17*b* of the spark plug 17 while at the same time the discharge current (secondary current i2) starts flowing.

The potential difference between the discharge voltage (electric potential Vp) immediately after spark discharge and the ground level (0 volt) decreases abruptly from the peak value to the potential difference $V_L$, and thereafter the potential difference changes so as to increase gradually. When this is the case, the discharge current (secondary current i2) decreases gradually and becomes zero (0 A) at the time t3.

Then, in FIG. 2B, a change from the time t1 to the time t2 is the same as that in FIG. 2A. The potential difference between the discharge voltage (potential Vp) immediately after spark discharge and the ground level (0 volt) decreases abruptly from the peak value to the potential difference $V_L$, and thereafter the potential difference decreases gradually. In this instance, the potential difference $V_L$ in FIG. 2B is larger than the potential difference $V_L$ in FIG. 2A. The discharge current (secondary current i2) decreases gradually and becomes zero (0 A) to finish the spark discharge at the time t4 earlier than the time t3.

In FIG. 2C, the change from the time t1 to the time t2 is the same as that in FIG. 2A. The potential difference between the discharge voltage (potential Vp) immediately after spark discharge and the ground level (0 volt) decreases abruptly from the peak value to the potential difference $V_L$, and thereafter the potential difference decreases at the rate faster than that in FIG. 2B. In this instance, the potential difference $V_L$ in FIG. 2C is larger than the potential difference $V_L$ in FIG. 2B. The discharge current (secondary current i2) decreases at the rate faster than that in FIG. 2B and becomes zero (0 A) to finish the spark discharge at the time t5 faster than the time t3.

From comparison of the foregoing results with respect to the duration of discharge (i.e., a period of time in which spark discharge continues), it will be understood that the normal discharge (a) is longest in duration, and the discharge (b) by a slightly fouled spark plug and the discharge (c) by a heavily fouled spark plug become shorter in duration in this order. Further, from comparison of the area which is calculated from the peak value of the discharge current (secondary current i2) waveform in FIGS. 2A and 2B, i.e., the integration value of the discharge current, it will be understood that the normal discharge (a) is largest in the integration value of discharge current, and the discharge (b) by a slightly fouled spark plug and the discharge (c) by a heavily fouled spark plug become smaller in the integration value of discharge current in this order.

Accordingly, by the use of the duration of spark discharge or the integration value of discharge current, it becomes possible to judge if the spark discharge produced at that moment is normal discharge or interior jumping. Since the interior jumping occurs at the stage of fouling prior to the stage in which the electrodes 17*a*–17*b* of the spark plug 17 are shorted due to adherence of carbon, a judgment of interior jumping enables detection of spark plug fouling at the stage prior to the stage in which the electrodes of the spark plug 17 have been shorted due to adherence of carbon.

In the meantime, from the comparison of the discharge voltage waveforms in FIGS. 2A and 2B, it will be seen that the potential difference $V_L$ at the time the potential difference decreases abruptly from the peak value is smallest in case of the normal discharge (a) and becomes smaller in case of the discharge (b) by a slightly fouled spark plug and the discharge (c) by a heavily fouled spark plug in this order. Further, the discharge voltage waveform from the time the potential difference $V_L$ is established to the time the spark discharge is finished, changes so as to become larger in the potential difference in case of the normal discharge (a) and become smaller in the potential difference in case of the discharge (b) by a slightly fouled spark plug and the discharge (c) by a heavily fouled spark plug. Thus, from the discharge voltage waveform, it can be judged if the spark discharge is a normal discharge or interior jumping.

Then, the fouling detection process executed by the ECU 21 made up of a microcomputer, in the internal combustion engine ignition system 1 of this embodiment will be described with reference to the flow chart of FIG. 3. The fouling detection process according to this embodiment carries out detection of spark plug fouling on the basis of an integration value of discharge current (secondary current i2) and starts, for example, when the engine starts.

In the meantime, the ECU 21 is provided for controlling the ignition timing, the fuel injection quantity, idling speed, etc. collectively, and performs, other than the fouling detection process which will be described hereinlater, various control processes such as an ignition control process for controlling spark discharge generated by a spark plug at an ignition timing, and an operation condition detecting process for detecting operating conditions at various portions of an engine such as an intake air quantity (intake pipe pressure) of an internal combustion engine, engine speed, throttle opening, coolant temperature, etc.

The fouling detection process starts when the internal combustion engine starts. Firstly, in step S110, it is judged if it is the time for ignition (ignition timing) which is separately controlled by an ignition control process. When the judgment is Yes, the program proceeds to S120. When the judgment in step S110 is No, the step S110 is repeated to wait the ignition timing. In the meantime, the ignition control process controls the IG signal so that a spark is generated at the ignition timing.

When it is the ignition timing (the time t2 in FIGS. 2A and 2B), the program proceeds to step S120 where a discharge current integration process for calculating the integration value of the discharge current (secondary current i2) is activated to start integrating the discharge current. In the ignition system 1 of the first embodiment, the discharge current integration value is calculated by the discharge current integration process which is separately carried out by the ECU 21, so that the discharge current integration process is activated in step S120.

Figure 11:
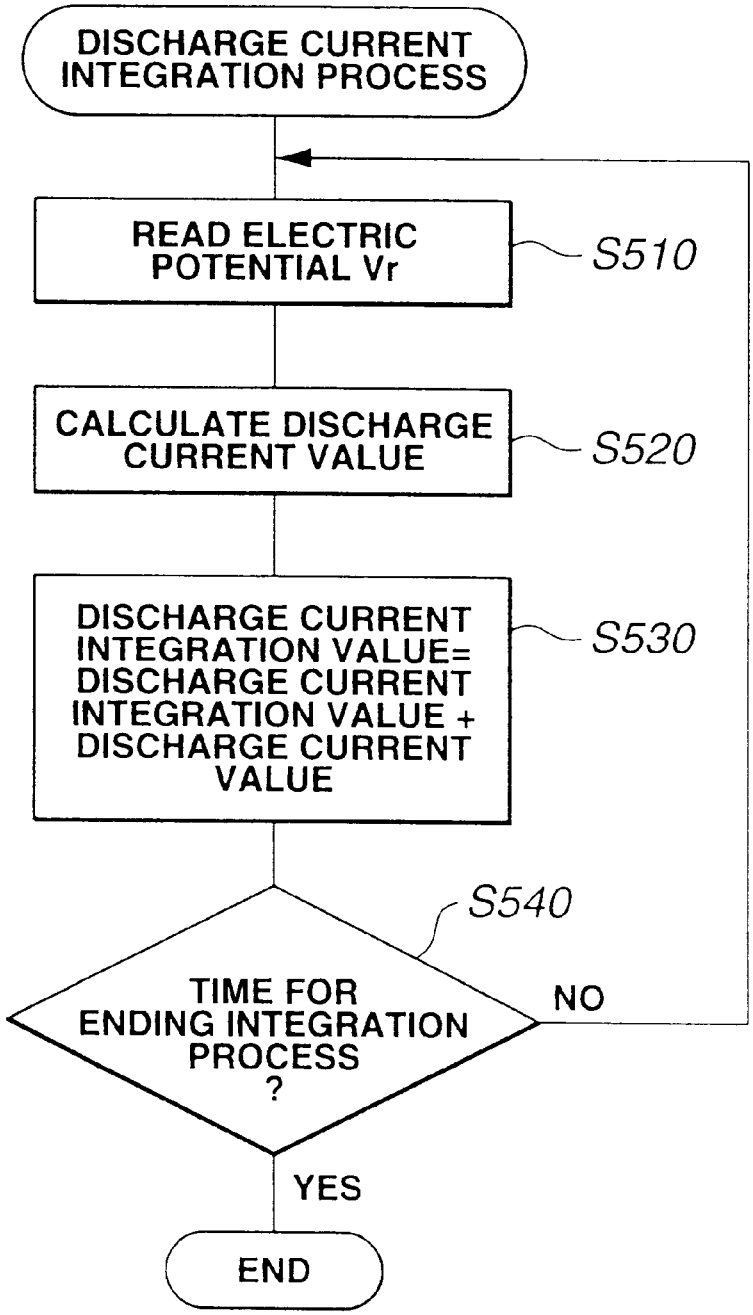
FIG. 11 is a flow chart of a discharge current integrating process executed by the ECU of FIG. 1.

The discharge current integration process will be described with reference to the flow chart of FIG. 11.

When the step S120 is executed to activate the discharge current integration process, firstly in step S510 the electric potential Vr at the secondary winding L2 side end portion of the detection resistor 19 is read. In step S520, the current value of the discharge current (secondary current i2) is calculated on the basis of the electric potential Vr read in step S510 and the resistance value of the detection resistor 19. Specifically, the value of the discharge current is calculated by dividing the electric potential Vr by the resistance value of the detection resistor 19.

In step S530, the discharge current integration value is updated by adding the value of the discharge current calculated in step S520 to the discharge current integration value, and then the program proceeds to step S540.

In step S540, it is judged if it is the time for ending the discharge current integration process. When the judgment is Yes, the discharge current integration process is ended. When the judgment is No, the program proceeds to step S510. In the meantime, the time for ending the process is judged on the basis of an integration ending flag which is set in step S140 of the fouling detection process, and when the integration ending flag is in the ON condition, it is judged that it is the time for ending the process (i.e., Judgment in step S540 is Yes).

In case it is not the time for ending the process at the time the program proceeds to step S540, i.e., judgment in Step S540 is No, the program returns back to step S510. During the time the integration ending flag is in the OFF condition, steps from S510 to S540 are repeated for thereby updating the discharge current integration value.

Thus, the discharge current integration process updates the discharge current integration value after the step S120 of the fouling detection process is executed and during the time the integration ending flag is in the OFF condition, and is ended when the integration ending flag is put into the ON condition.

Figure 3:
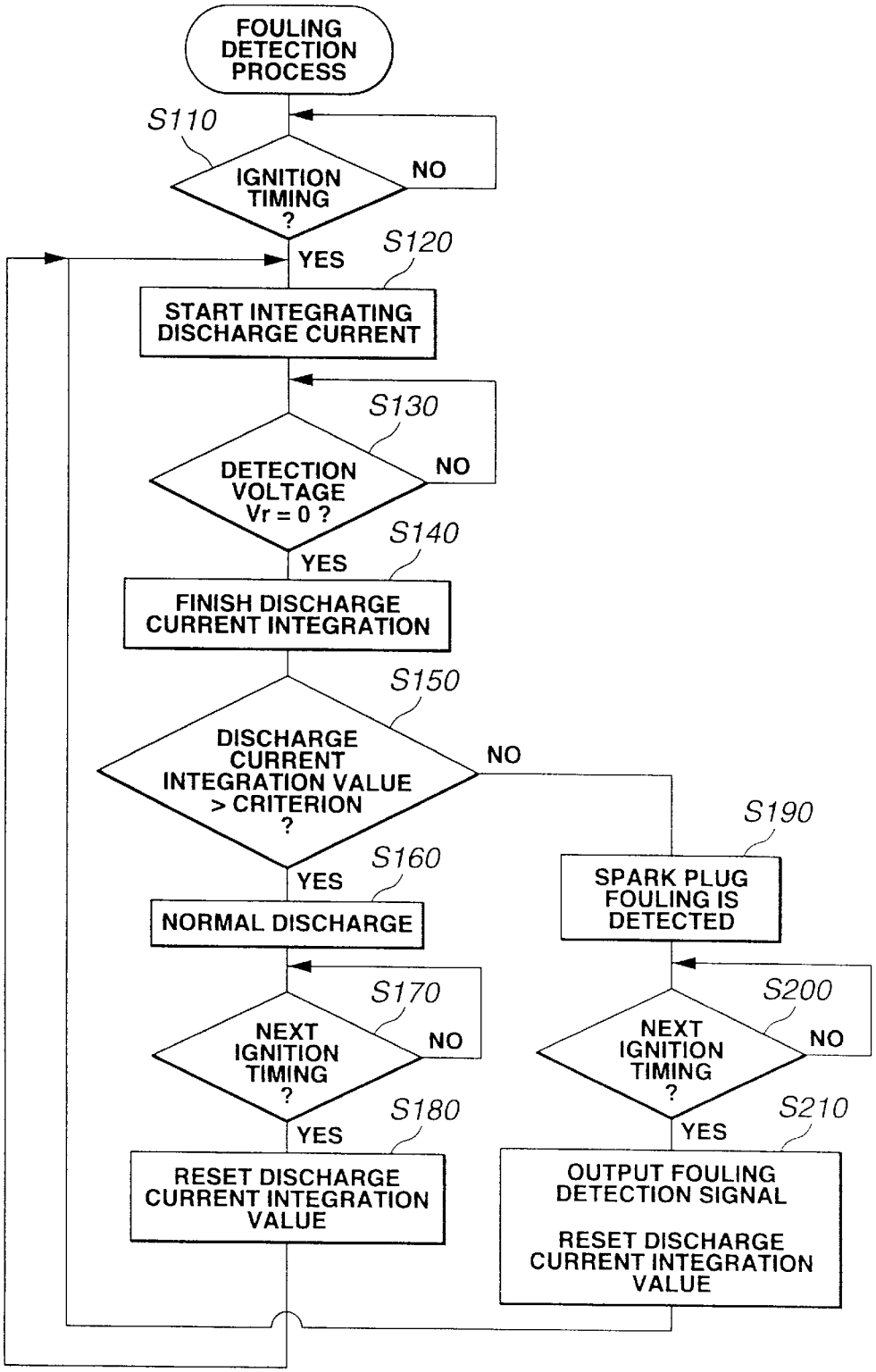
FIG. 3 is a flow chart of a spark plug fouling detecting process executed by an ECU of the ignition system of the first embodiment.

On the other hand, in the fouling detection process in FIG. 3, the program proceeds to step S120 to activate the discharge current integration process and thereafter proceeds to step S130 where it is judged if the detection voltage (electric potential Vr) is zero (0 volt). When the judgment is Yes, the program proceeds to step S140. When the judgment is No, step S130 is repeated to wait until the electric potential Vr becomes zero (0 v). In the meantime, in step S130, the finish or completion of spark discharge is detected on the basis of the detection voltage.

When the spark discharge is finished and the electric potential Vr becomes zero (i.e., at the times t3, t4 and t5 in FIGS. 2A to 2C), the judgment in step 130 is Yes and the program proceeds to S140. In step S140, the integration ending flag is put into an ON condition in order to finish the discharge current integration process. By this, the discharge current integration process activated in step S120 judges the finish time or timing on the basis of the integration ending flag and finishes the process of updating the discharge current integration value.

After execution of the step S140, the program proceeds to step S150 where it is judged if the discharge current integration value calculated by the above described discharge current integration process is larger than a predetermined integration value criterion. When the judgment is Yes, the program proceeds to step S160 where it is judged that the spark discharge is normal discharge. Then, in step S170, it is judged, similarly to step S110, if it is the time for ignition (i.e., ignition timing) which is separately controlled by the ignition control process. When the judgment is Yes, the program proceeds to step S180. When the judgment is No, step 170 is repeated to wait the ignition timing.

When it is the ignition timing, the judgment in step S170 is Yes and the program proceeds to step S180 where the discharge current integration value is updated to zero (0) for thereby resetting the discharge current integration value. After execution of step S180, the program proceeds to step S120.

When the judgment in step S150 is No, i.e., the discharge current integration value is smaller than the criterion, the program proceeds to step S190 where it is judged that the spark plug is in a fouled condition.

After execution in step S190, the program proceeds to step S200 where it is judged, similarly to the above described step S110, if it is the time for ignition (i.e., ignition timing). When the judgment is Yes, the program proceeds to step S210. When the judgment is No, step 200 is repeated to wait the ignition timing.

When the judgment in step S200 is Yes, i.e., when it is the ignition timing, the program proceeds to step S210. In step S210, a process for countermeasure against fouling such as one for outputting a fouling detecting signal and switching on an alarm lamp (not shown in FIG. 1) is performed and the discharge current integration value is updated to 0 (zero) for thereby resetting the discharge current integration value. After execution of step S210, the program proceeds to step S120.

As having been described above, by repeated execution of steps from S120 to S210 in the fouling detection process, the fouled spark plug condition is detected on the basis of the calculated discharge current integration value.

In the meantime, the integration value criterion used in step S150 is previously set so that the discharge current integration value at the time of normal discharge and the discharge current integration value at the time of interior jumping are distinguishable from each other. In this instance, the result of measurement of the discharge current integration value at the time of normal discharge and the discharge current integration value at the time of interior jumping are shown in FIG. 4.

Measurement was made in such a manner that 200 times spark discharge were carried out to obtain the discharge current integration value at each spark discharge by calculation and judgment on whether each spark discharge is normal discharge or interior jumping was made on the basis of the discharge voltage waveform.

Figure 4:
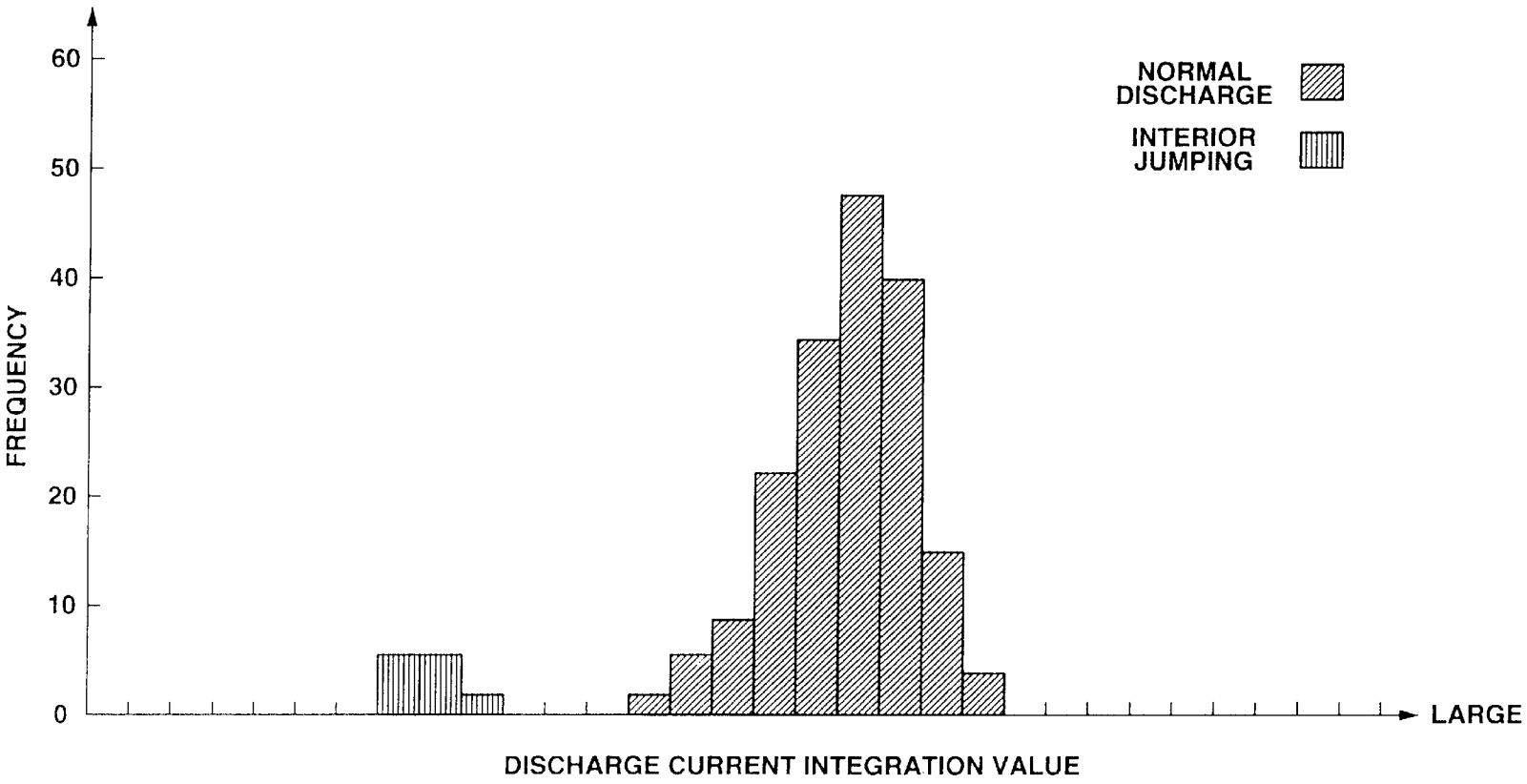
FIG. 4 is a graph showing the result of measurement of a discharge current integration value at the time of normal discharge and interior jumping.

FIG. 4 shows the result of measurement by using a histogram in which the discharge current integration value of normal discharge and interior jumping is taken as abscissa and the frequency of normal discharge and interior jumping is taken as ordinate, and the distribution of normal discharge and the distribution of interior jumping are indicated by different patterns.

From FIG. 4, it will be seen that the distribution of the discharge current integration value at the time of normal discharge and the distribution of the discharge current integration value at the time of interior jumping are concentrated at the different discharge current integration values, respectively and the distribution of the discharge current integration value at the time of normal discharge is concentrated at larger discharge current integration values than the distribution of the discharge current integration value at the time of interior jumping.

Accordingly, by setting the integration value criterion at a value included within a range between the range at which the discharge current integration value at the time of normal discharge is concentrated and the range at which the discharge current integration value at the time of interior jumping is concentrated, it becomes possible to discriminate between normal discharge and interior jumping correctly in the above described step S150.

Figure 5:
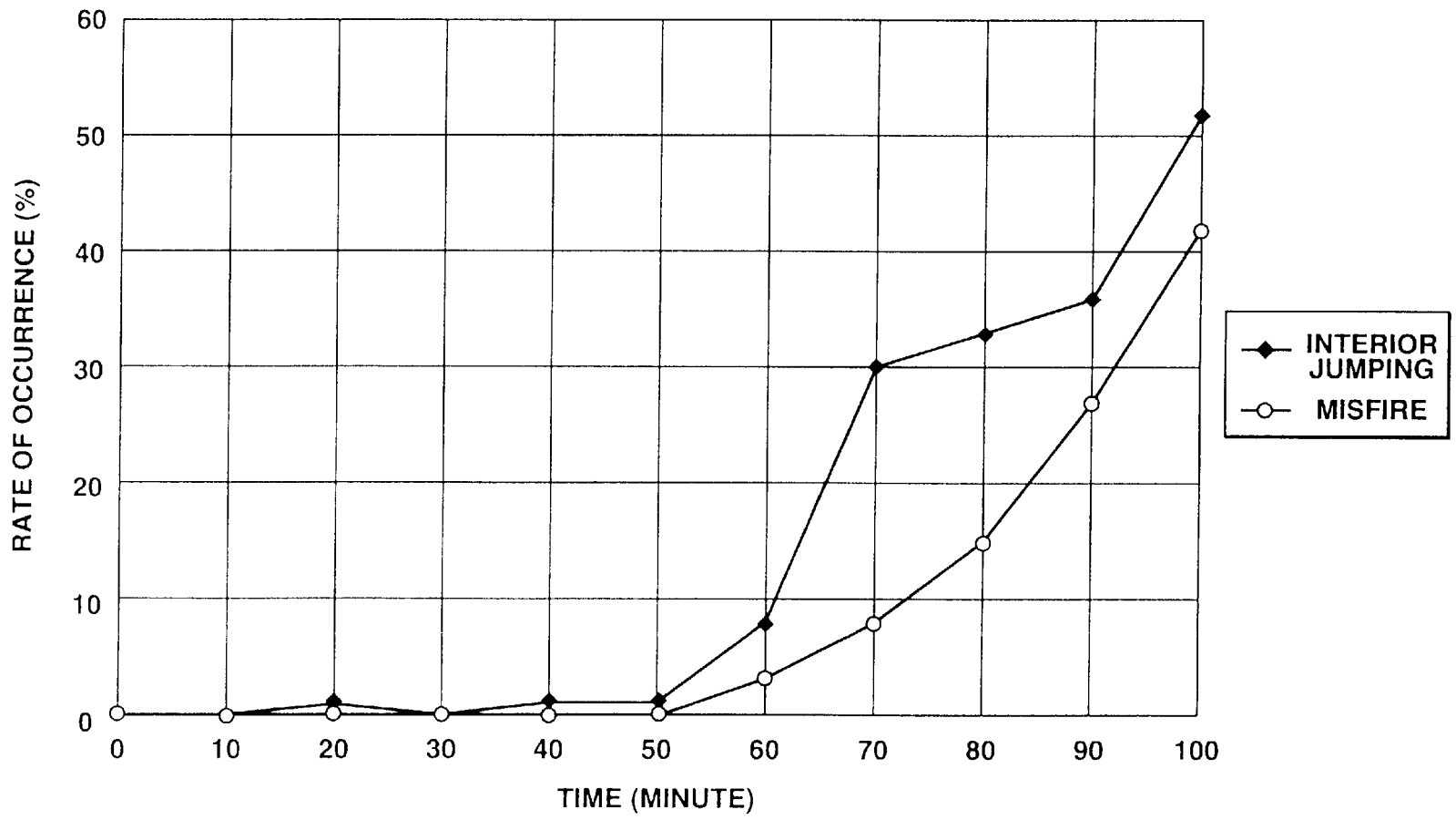
FIG. 5 is a graph showing the result of measurement of the rate of occurrence of normal discharge and interior jumping.

The result of measurement of interior jumping and misfire is shown in FIG. 5. Measurement was made in such a manner that when the internal combustion engine was operated for 100 minutes continuously, the interior jumping and misfire caused at each time zone were measured. FIG. 5 is a graph with the abscissa as time and the ordinate as rate of occurrence.

From the result of measurement shown in FIG. 5, it will be seen that the rate of occurrence of misfire is lower than that of interior jumping at all time zones. Further, it will be seen that after the rate of occurrence of interior jumping has risen, the rate of occurrence of misfire rises in such a manner as to follow in wake of the rate of occurrence of interior jumping. From this, by detecting the interior jumping, it becomes possible to predict occurrence of misfire beforehand.

Accordingly, by the fouling detection process of this embodiment, the spark plug is judged to have been fouled when the calculated discharge current integration value decreases down to such an value at the time of interior jumping, it becomes possible to predict a misfire beforehand.

As having been described as above, by the fouling detection process executed by the ECU 21 of the ignition system 1 of this embodiment, it is first judged if it is the time for generation of spark discharge. The spark discharge is generated by application of a high voltage produced by an ignition coil to a spark plug. When it is judged that it is the time for generation of spark discharge, it is calculated, by the discharge current integration process, the integration value of the discharge current flowing through the spark plug during the duration of spark discharge (i.e., during a spark plug discharge period). On the basis of the calculated discharge current integration value, it is judged if interior jumping is occurring, i.e., if the spark plug has been fouled. Specifically, in case the calculated discharge current integration value is lower than a predetermined integration value criterion, it is judged that an interior jumping is occurring, i.e., spark plug fouling has been caused.

Further, in this embodiment, detection of discharge current is performed by the use of the detection resistor 19 connected in series to an electric current path consisting of the secondary winding L2 and the spark plug 17. All the discharge current therefore flows through the detection resistor 19 without causing any leakage, thus making it possible to detect the discharge current accurately.

Further, the resistance value of the detection resistor 19 is 100Ω, so the potential difference between the opposite ends of the detection resistor 19 at the time the discharge current flows through the detection resistor 19, can be of such an amount that is not affected by a noise. Thus, it becomes possible to detect the discharge current by suppressing the influence of noise, thus making it possible to improve the detection accuracy. Further, the resistance value of the detection resistor 19 is smaller than the equivalent resistance (about 1 MΩ) between the electrodes of the spark plug when carbon fouling or the like contamination has occurred around the electrodes of the spark plug. Thus, the ignition high voltage applied from the ignition coil to the spark plug can be maintained at such a value that enables generation of spark discharge, thus making it possible to maintain a good operation of the internal combustion engine.

Figure 6:
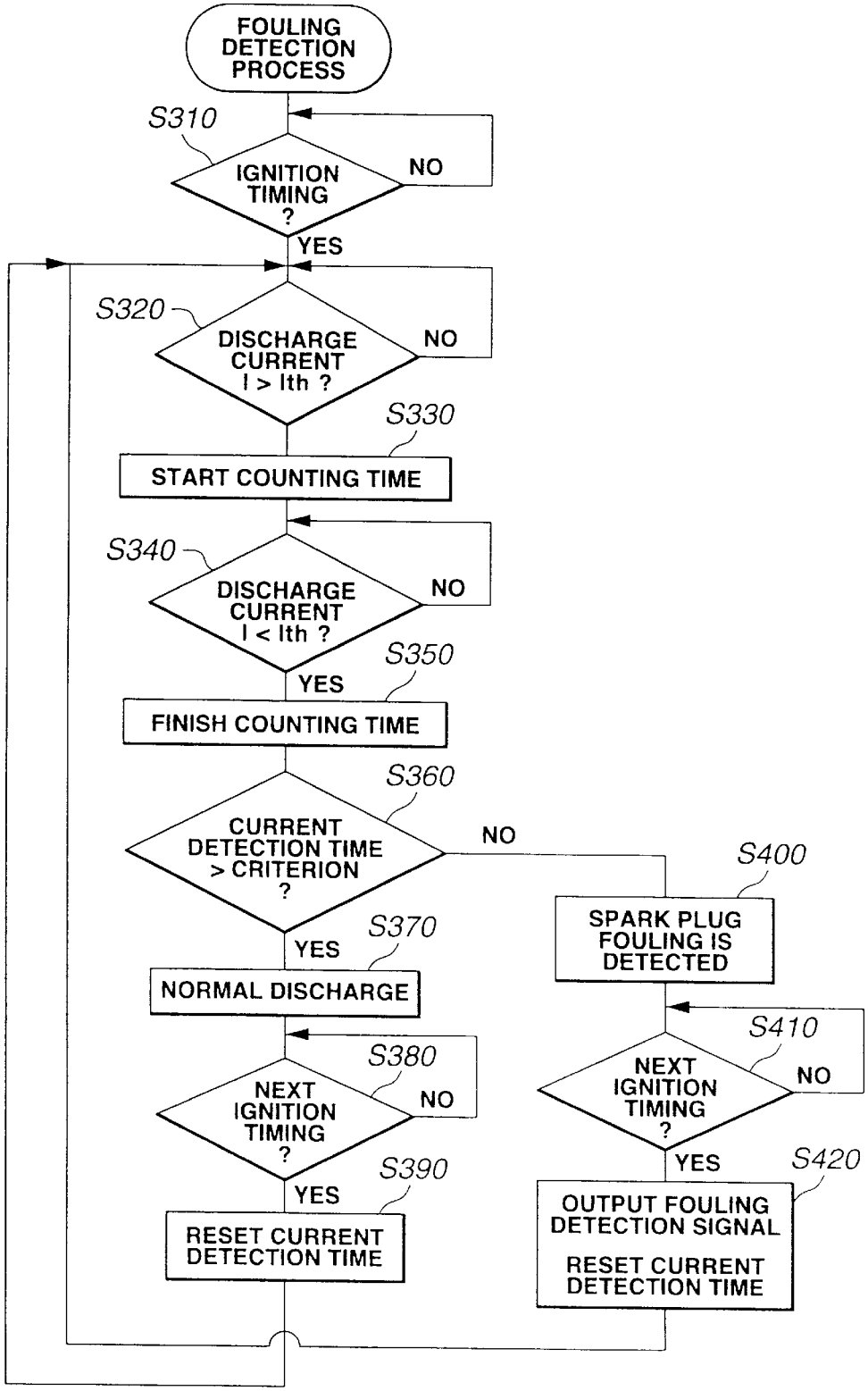
FIG. 6 is a flow chart of a spark plug fouling detecting process according a second embodiment, which is executed by the ECU of FIG. 1.

Referring to FIG. 6, a second embodiment will be described.

In the first embodiment, spark plug fouling is detected on the basis of the integration value of discharge current. In the second embodiment, spark plug fouling is detected on the basis of a current detection time which is a period of time during which the flow of discharge current through the spark plug at a spark discharge period continues. In the meantime, the structure of the internal combustion engine ignition system according to the second embodiment is the same as that of the first embodiment shown in FIG. 1, and therefore description will hereinlater be made as to a portion different from the first embodiment, i.e., a fouling detection process with reference to the flow chart of FIG. 6.

The fouling detection process according to the second embodiment starts when the engine starts. Firstly, in step S310, it is judged if it is the time for ignition (i.e., ignition timing) which is controlled by an ignition control process which is separately executed. When the judgment is Yes, the program proceeds to S320. When the judgment in step S310 is No, the step S310 is repeated to wait the ignition timing.

When it is the ignition timing (the time t2 in FIGS. 2A and 2B), the program proceeds to step S320 where it is judged if the detected discharge current I is larger than a predetermined current value criterion Ith (e.g., 5 mA). When the judgment is Yes, the program proceeds to step S330. When the judgment is No, step S320 is repeated to wait until I>Ith. In the meantime, the discharge current I is calculated on the basis of the electric potential Vr and a predetermined resistance value of the detection resistor 19. Specifically, the value of the discharge current I is calculated by dividing the electric potential Vr by the resistance value of the detection resistor 19.

When the judgment in step S320 is Yes, i.e., the detected discharge current I becomes larger than the detection current value criterion Ith, the program proceeds to step S330 where the time at that moment is stored in order to start counting the detection time of the discharge current.

In step S340, it is judged if the discharge current I is smaller than the current value criterion Ith. When the judgment is Yes, the program proceeds to step S350. When the judgment is No, step S340 is repeated to wait until I<Ith. In step S340, the completion of spark discharge is detected. However, since extra current is generated due to an influence of noise or the like, the discharge current I to be detected does not necessarily decrease to 0 mA. Thus, by comparing the discharge current I with the current value criterion Ith which is set at a value larger than a current value which is generated by noise, it is intended to detect the completion of spark discharge accurately. In the meantime, in case there is no influence of noise, the current value criterion can be set at 0 mA.

When the discharge current I becomes smaller than the current value criterion Ith, i.e., the judgement in step S340 is Yes, the program proceeds to step S350 where the current detection time of the discharge current is calculated by subtracting the time stored in step S330 form the time at this moment and the counting of the detection time is finished.

In step S360, it is judged if the current detection time of the discharge current calculated in step S350 is larger than the current value criterion. When the judgment is Yes, the program proceeds to step S370. When the judgment is No, the program proceeds to step S400.

In step S360, it is judged that the spark discharge is normal discharge.

After step S370, the program proceeds to step S380 where it is judged, similarly to step S310, if it is the time for ignition (i.e., ignition timing) which is controlled by the ignition control process which is executed separately. When the judgment is Yes, the program proceeds to step S390. When the judgment is No, step S380 is repeated to wait the ignition timing.

When it is the ignition timing, i.e., the judgment in step S380 is Yes, the program proceeds to step S390 where the current detection time is updated to zero (0) for thereby resetting the current detection time. After execution of step S390, the program returns back to step S320.

Further, when the judgment in step S360 is No, i.e., the current detection time is smaller than a detection time criterion, then program proceeds to step S400 where it is judged that the spark plug is in a fouled condition.

After execution of step S400, the program proceeds to step S410 where it is judged, similarly to the above described step S310, if it is the time for ignition (ignition timing). When the judgment is Yes, the program proceeds to step S420. When the judgment is No, step 410 is repeated to wait the ignition timing.

When the judgment in step S410 is Yes, i.e., when it is the ignition timing, the program proceeds to step S420. In step S420, a process for countermeasure against fouling such as one for outputting a fouling detecting signal and switching on an alarm lamp (not shown in FIG. 1) is performed and the current detection time is updated to 0 (zero) for thereby resetting the current detection value. After execution of step S420, the program returns back to step S320.

As having been described above, by repeating steps from S320 to S420 in the fouling detection process which is executed by the ECLJ 21 of the ignition system 1, the fouled spark plug condition is detected on the basis of the calculated current detection time.

In the meantime, the detection time criterion used in step S360 is previously set so as to be able to discriminate between the current detection time at the time of normal discharge and the current detection time at the time of interior jumping. In this instance, the result of measurement of the detection time at the time of normal discharge and the detection time at the time of interior jumping are shown in FIG. 7.

Measurement was made in such a manner that 200 times spark discharge were carried out to obtain the current detection time at each spark discharge by calculation and judgment on whether each spark discharge is normal discharge or interior jumping was made on the basis of the discharge voltage waveform. In the meantime, in this measurement, by judging the time during which the discharge current (secondary current i2) is held equal to or higher than 5 mA as a current detection time, the current detection time was calculated. FIG. 7 shows the result of measurement by using a histogram in which the current detection time of normal discharge and interior jumping is taken as abscissa and the frequency of normal discharge and interior jumping is taken as ordinate, and the distribution of normal discharge and the distribution of interior jumping are indicated by different patterns.

Figure 7:
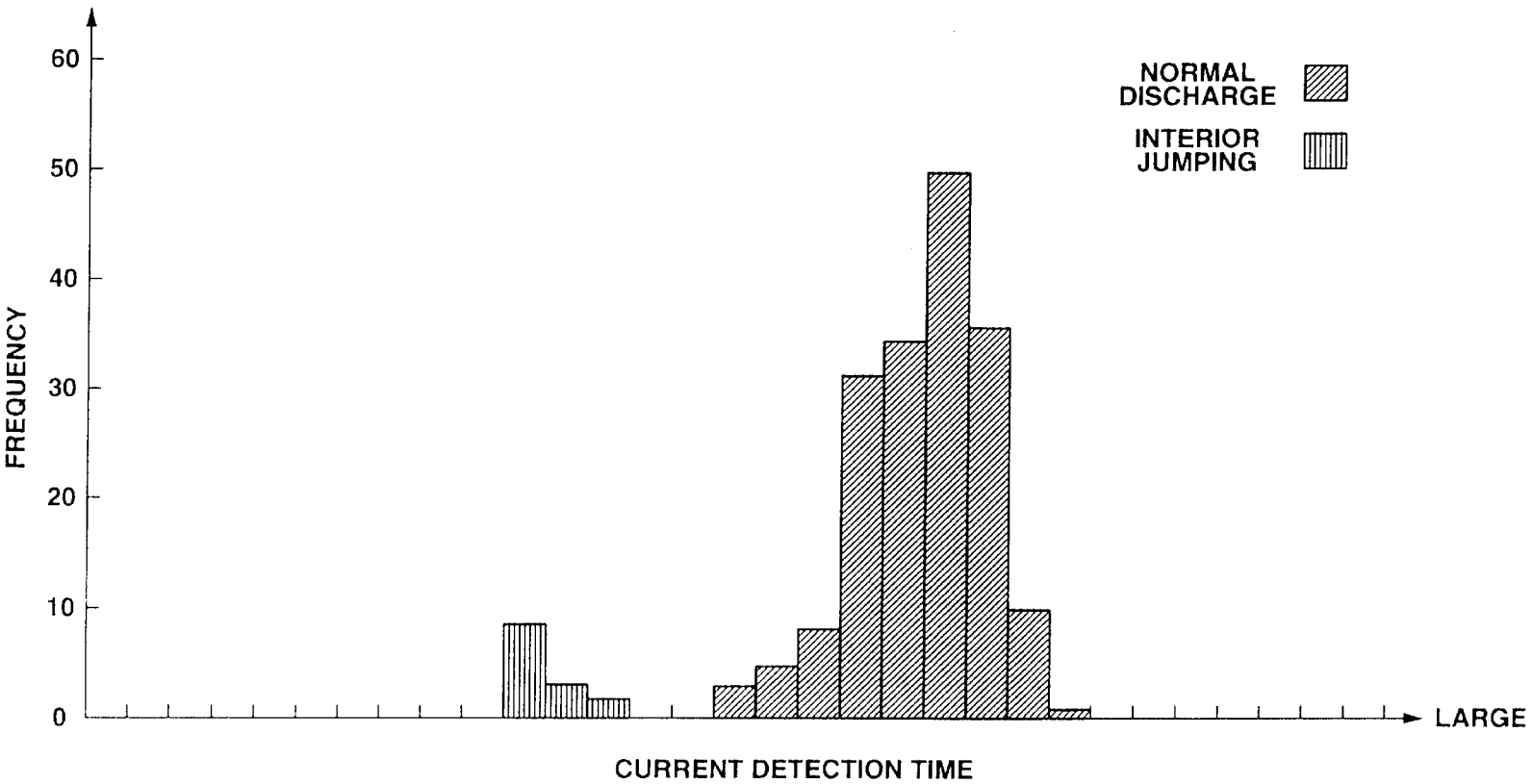
FIG. 7 is a graph showing the result of measurement of current detection time at the time of normal discharge and interior jumping.

From FIG. 7, it will be seen that the distribution of the current detection time at normal discharge and the current detection time at interior jumping are concentrated at the different current detection times, respectively and the distribution of the current detection time at the time of normal discharge is concentrated at a zone of a larger current detection time than the current detection time at the time of interior jumping.

Accordingly, by setting the detection time criterion at a value included within a range between the range at which the current detection time at the time of normal discharge is concentrated and the range at which the current detection time at the time of interior jumping is concentrated, it becomes possible to discriminate between normal discharge and interior jumping correctly in the above described step S360.

Further, by detecting the interior jumping from the result of measure shown in FIG. 5, it has already been revealed that the occurrence of a misfire is predictable. By the fouling detection process according to the second embodiment, in which the spark plug is judged to have been fouled when the calculated current detection time becomes equal to the current detection time at the time of interior jumping, a misfire is also predictable.

As having been described above, in the ignition system 1 of the second embodiment, when it is judged that it is the time for generation of spark discharge which is generated by application of a high voltage for ignition generated by an ignition coil to a spark plug, a current detection time which is a period of time during which the flow of discharge current between the electrodes of the spark plug at a spark plug discharge period continues. On the basis of the current detection time, it is judged if interior jumping is occurring, i.e., if the spark plug has been fouled. Specifically, when the calculated detection time is shorter than a predetermined detection time criterion, it is judged that interior jumping is occurring, i.e., spark plug fouling has been caused.

Figure 8:
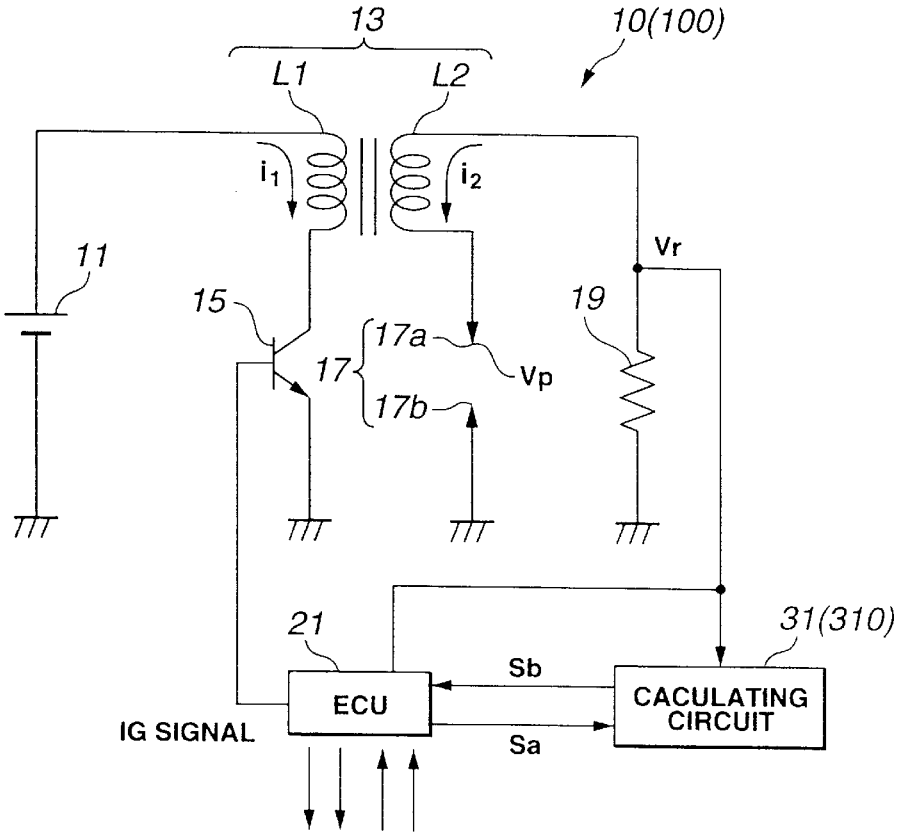
FIG. 8 is a circuit diagram of an ignition system of an internal combustion engine according to a third or fourth embodiment

Description will now be made as to the third embodiment in which a discharge current integration value is calculated by the use of an analogue circuit and detection of fouling is made on the basis of the calculated discharge current integration value. FIG. 8 shows an internal combustion engine ignition system 10 according to the third embodiment.

As shown FIG. 8, the ignition system 10 of the third embodiment, includes a power unit (battery) 11 for supply of an electric energy for spark discharge (e.g., voltage of 12V), an ignition coil 13 consisting of a primary winding L1 and a secondary winding L2, an npn transistor 15 connected in series with the primary winding L1, a spark plug 17 provided to a cylinder of the internal combustion engine, a detection resistor 19 having a resistance value of 100Ω and connected at an end to the secondary winding L2 and grounded at the other end, a calculating circuit 31 consisting of an analogue circuit that receives a voltage Vr across a connecting point of the detection resistor 19 to the secondary winding L2 to set a discharge current integration signal Sb representative of a discharge current integration value, and an electronic control unit (ECU) 21 that outputs an IG (ignition) signal to the transistor 15, outputs an integration reset signal Sa to the calculating circuit 31, receives a voltage Vr across a connecting point of the detection resistor 19 to the secondary winding L2, and receives a discharge current integration signal Sb from the calculating circuit 31.

Figure 9:
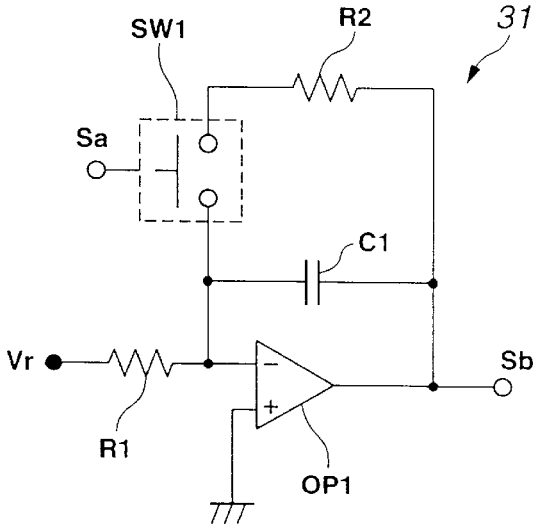
FIG. 9 is a circuit diagram of a calculating circuit of the ignition system according to the third embodiment.

The internal combustion engine ignition system 10 of the third embodiment differs from the ignition system 1 of the first embodiment in that the calculating circuit 31 is additionally provided. Referring to FIG. 9, the calculating circuit 31 will be described.

As shown in FIG. 9, the calculating circuit 31 is an integrating circuit provided with an operational amplifier OP1. The operational amplifier OP1 is grounded at a non-inverting input terminal (+) and has an inverting input terminal (−). The inverting input terminal (−) is connected, by way of a resistor R1, to an end of the detection resistor 19 from which an electric potential Vr is outputted. An output terminal of the operational amplifier OP1 is connected to the ECU 21 to supply thereto a discharge current integration signal Sb as an output. Further, a series circuit consisting of a switch SW1 and a resistor R2 is connected in parallel with a capacitor C1. An input terminal of the switch SW1 is connected to the ECU 21 so that the integration reset signal Sa is inputted to the input terminal of the switch SW1.

In the meantime, the switch SW1 has therewithin a switching portion which is constructed to close when an electric signal inputted to the input terminal is high in level(e.g., 5 volts) and open when the electric signal inputted to the input terminal is low in level (e.g., 0 volt).

The switching portion of the switch SW1 is arranged in a closed (connection path) consisting of a resistor R2 and the capacitor C1 so that the switch SW1 performs short-circuiting and disconnection of the connection path on the basis of the integration reset signal Sa. When the integration reset signal Sa is low in level, the switching portion opens to disconnect the connection path. When the integration reset signal Sa is high in level, the switching portion closes to short-circuit the connection path and establish a closed loop consisting of the resistor R2 and the capacitor C1. When the closed loop consisting of the resistor R2 and the capacitor C1 is established, a charge accumulated in the capacitor C1 causes a current to flow through the closed loop, thus causing the capacitor C1 to be discharged by lapse of time.

In the calculating circuit 31 structured as above, when the electric potential Vr at the connecting end of the detection resistor 19 to the secondary winding L2 increases above the ground potential, a current flows by way of the resistor R1 and by this current a charge is accumulated in the capacitor C1. In this connection, the electric potential Vr increases above the ground potential during the time the discharge current (secondary current i2) is flowing. Thus, the charge accumulated in the capacitor C1 increases in accordance with the integration value of the discharge current (secondary current i2).

Due to this, the electric potential at the output terminal of the operational amplifier OP1 varies in accordance with the voltage across the opposite ends of the capacitor C1, i.e., the charge accumulated in the capacitor C1. In the calculating circuit 31, the electric potential at the output terminal of the operational amplifier OP1 is regarded as a discharge current integration signal Sb representative of a discharge current integration value, and the discharge current integration signal Sb is supplied to the ECU 21.

On the other hand, when the ECU 21 causes the integration reset signal Sa to become high in level, the switch SW1 is put into an ON condition to short-circuit the connection path and establish a closed loop consisting of the capacitor C1 and the resistor R2. By this, a current flows through the closed loop by the effect of the charge accumulated in the capacitor C1. In this instance, an electric power is consumed at the resistor R2, whereby to cause the capacitor C1 to be discharged. When the capacitor C1 is completely discharged, the electric potential at the output terminal of the operational amplifier OP1 to become 0 (zero). By this, the discharge current integration value stored inside the calculating circuit 31 is reset.

In this manner, the ECU 21 in the ignition system 1 of the third embodiment does not calculate the discharge current integration value by its internal processing but receives the discharge current integration signal Sb determined by the calculating circuit 31 to derive the discharge current integration value therefrom. That is, in the above described first embodiment, the discharge current integration value is calculated by the discharge current integration process which is an internal processing carried out within the ECU 21. In contrast to this, in the third embodiment, the discharge current integration value is obtained by derivation by the use of the calculating circuit 31.

Then, described will be made as to a fouling detection process executed by the ECU 21 of the ignition system 10 of the third embodiment. The fouling detection process of the third embodiment is similar to that of the first embodiment in that the spark plug fouling is detected on the basis of a discharge current integration value but differs therefrom in the method of calculation of the discharge current integration value. Thus, the fouling detection process of the third embodiment will be described with respect to its portion different from the routine in the flow chart of FIG. 3, i.e., a portion relating to the steps from S120 to S140, S180 and S210 of the flow chart of FIG. 3.

Firstly, in step S120 of the first embodiment, the discharge current integration process is activated. In contrast to this, in step S120 of the third embodiment, any particular process is not executed.

In step S130 of the third embodiment, it is judged, similarly to the first embodiment, if the detection voltage (electric potential Vr) is 0 v (zero volt). When the judgment is Yes, the program proceeds to step S140. When the judgment is No, step S130 is repeated to wait until the electric potential becomes 0 v (zero volt).

When the spark discharge is completed and the electric potential Vr becomes zero volt (i.e., the times t3, t4 and t5 in FIGS. 2A to 2C), i.e., when the judgement in step S130 is Yes, the program proceeds to step S140. In step S140 of the first embodiment, an integration ending flag is put into an ON condition for thereby ending the discharge current integration process. In contrast to this, in the third embodiment, the calculating circuit 31 finishes calculating the discharge current in dependence upon a variation of the electric potential Vr. Thus, in step S140 of the third embodiment, there is not any processing for ending the discharge current integration process. However, in step S140 of the third embodiment, the discharge current integration signal Sb outputted by the calculating circuit 31 is read and a processing for calculating a discharge current integration value on the basis of the level of the discharge current integration signal Sb (actually, an electric potential at the output terminal of the operational amplifier OP1).

Thereafter, in steps S150 and onward, similar processing to the first embodiment is executed except for steps S180 and S210.

In step S180 of the third embodiment, the integration reset signal Sa is made high in level, and the discharge current integration value maintained inside the calculating circuit 31 (actually, the amount of charge accumulated in the capacitor C1) is reduced to 0 (zero) for thereby resetting the discharge current integration value. After execution of step S180, the program returns back to step S120.

In step S210 of the third embodiment, a process for countermeasure against fouling such as one for outputting a fouling detecting signal and switching on an alarm lamp (not shown in FIG. 8) is performed, the integration reset signal Sa is made high in level, and the discharge current integration value maintained inside the calculating circuit 31 (actually, the amount of charge accumulated in the capacitor C1) is updated to 0 (zero) for thereby resetting the discharge current integration value. After execution of step S210, the program returns back to step S120.

The spark plug fouling detection process of the third embodiment executes the above described steps from S120 to S210 repeatedly and detect the spark plug fouled condition on the basis of the discharge current detection value calculated by the means of the calculating circuit 31.

Thus, the internal combustion engine ignition system 10 of the third embodiment detects the spark plug fouling on the basis of the discharge current integration value similarly to the first embodiment and therefore can produce substantially the same effect as the first embodiment. Further, in the third embodiment, the discharge current integration value is calculated by the use of the calculating circuit (analog circuit) 31, thus making it unnecessary for the ECU 21 to execute the discharge current integration process and therefore making it possible to suppress increase in the processing load of the ECU 21 resulting for execution of internal processing. Accordingly, the load of the ECU 21 can be reduced or mitigated.

In the meantime, while in the third embodiment, the operation of the switch SW1 is controlled by the use of the integration reset signal Sa which is controlled by the fouling detection process, it can be controlled by the use of the IG signal which is controlled by the ignition control process. This is because it will do to reset the discharge current integration value before the time of generation of a high voltage for ignition, which time overlaps the time the IG signal is put into an ON condition. By this, it becomes possible to eliminate the process step in the fouling detection process for controlling the integration reset signal Sa, thus making it possible to reduce and mitigate the processing load on the ECU 21.

Then, description will be made to an internal combustion engine ignition system 100 (refer to FIG. 8) according to the fourth embodiment wherein a current detection time which is the period of time during which the flow of discharge current continues is calculated by the use of an analog circuit and spark plug fouling is detected on the basis of the calculated current detection time.

Figure 10:
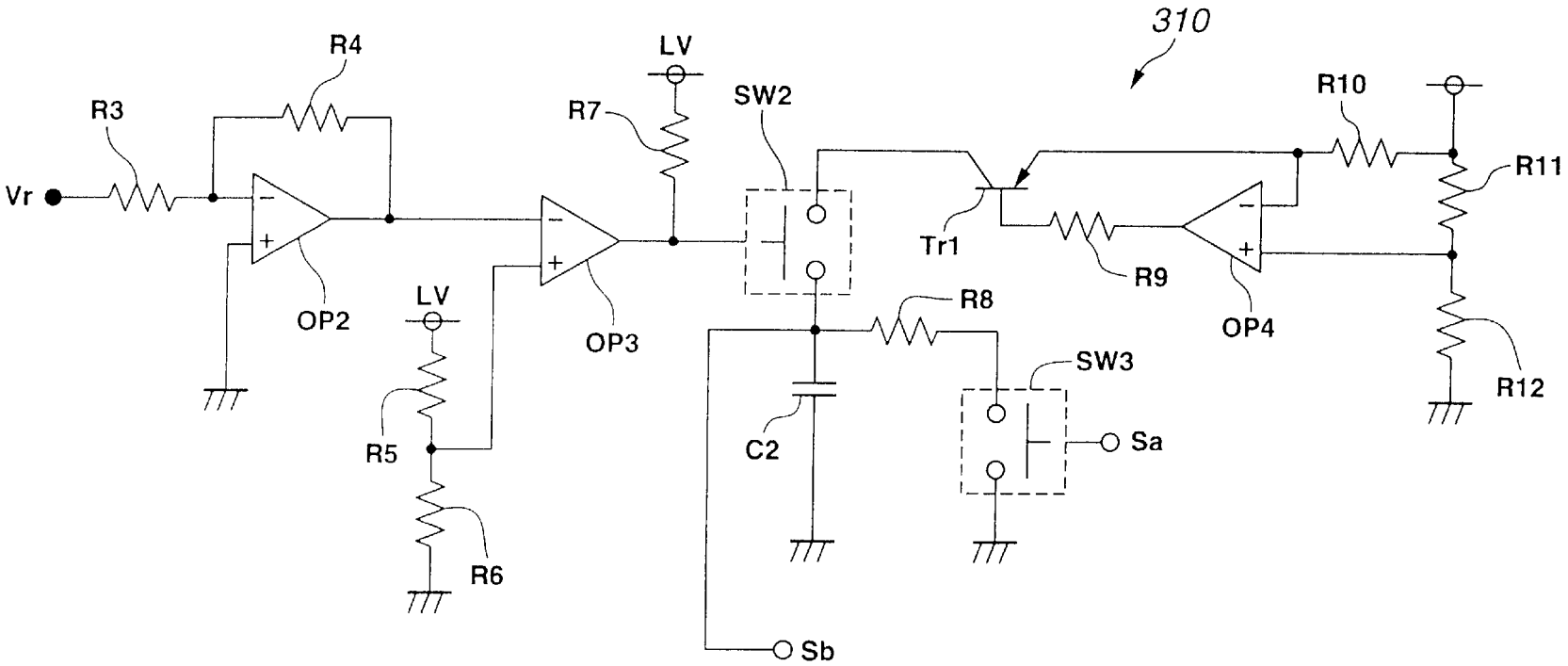
FIG. 10 is a circuit diagram of a calculating circuit according to the fourth embodiment.

The internal combustion engine ignition system 100 of the fourth embodiment is similar to the third embodiment except for the calculating circuit 310 shown in FIG. 10. Referring to FIG. 10, the calculating circuit 310 will be described.

The calculating circuit 310 includes an operational amplifier OP2 with an inverting input terminal (−) connected by way of a resistor R3 to an end of the detection resistor 19 which outputs an electric potential Vr, an operational amplifier OP3 with an inverting input terminal (−) connected to an output terminal of the operational amplifier OP2, and a switch SK2 with an input terminal connected to the output terminal of the operational amplifier OP3.

The operational amplifier OP2 is grounded at a noninverting input terminal (+) and changes the electric potential at the output terminal on the basis of the electric potential Vr and the ground potential. That is, in dependence upon a variation of the electric potential Vr, the electric potential at the output terminal OP2 is varied.

Further, the operational amplifier OP3 is connected at the noninverting input terminal (+) to the junction between a resistor R5 and a resistor R6 of a series circuit. The series circuit of the resistors R5 and R6 is connected at the resistor R5 side end thereof to a power line LV and is grounded at the resistor R6 side end. That is, the operational amplifier OP3 compares the electric potential caused by dividing the electric potential of the power line Lv by the resistor R5 and the resistor R6 and the electric potential at the output terminal of the operational amplifier OP2 and changes the electric potential at the output terminal to low in level (e.g., ground potential 0 v) or high in level (e.g., 5 v). In the meantime, the power line LV is supplied with an output (e.g., 5 v) from a constant-voltage regulated power supply (not shown). Further, the value of the discharge current at the time the electric potential at the output terminal of the operational amplifier OP3 is changed higher in level is determined in dependence upon the resistance values of the resistor R5 and resistor R6.

Further, the operational amplifier OP3 is connected at the output terminal to the input terminal of the switch SW2 and to the power line LV by way of a resistor R7. When the electric potential at the output terminal of the operational amplifier OP3 is low in level, the flow of current from the power line LV and through the resistor R7 is supplied to the output terminal of the operational amplifier OP3. When the electric potential at the output terminal of the operational amplifier OP3 is high in level, the electric potential at the power line LV is equal to that at the output terminal so that there is not caused any current flowing through the resistor R7. In the meantime, by connecting the output terminal of the operational amplifier OP3 to the power line LV by way of the resistor R7, it is intended to suppress a variation of the electric potential at the output terminal of the operational amplifier OP3 by the influence of the switch S2.

The switch SW2 is structured similarly to the switch SW1 and has a switching portion inside thereof. When the voltage signal inputted to the input terminal of the switch SW2 is high in level (e.g., 5 v), the switching portion closes. When the voltage signal inputted to the input terminal is low in level (e.g., ground potential 0 v), the switching portion opens.

The switching portion of the switch SW2 is provided to a connecting path connecting between a collector of a transistor Tr1 and a capacitor C2. The switch SW2 short-circuits or disconnects the connecting path on the basis of the electric potential at the output terminal of the operational amplifier OP3, which is inputted to the input terminal thereof. When the electric potential at the output terminal of the operational amplifier OP3 is changed to low in level, the switch SW2 is put into an OFF condition to disconnect the connecting path. When the electric potential at the output terminal of the operational amplifier OP3 is changed to high in level, the switch SW2 is put into an ON condition to short-circuit the connecting path.

The calculating circuit 310 further includes an operational amplifier OP4 with an inverting input terminal (−) connected to a power line LV by way of the resistor 10, a pnp transistor Tr1 with a base connected to the output terminal of the operational amplifier OP4 by way of a resistor R9 and a capacitor C2 connected at an end to the collector of the transistor Tr1 by way of the switch SW2 and grounded at the other end.

The junction between a power line LV and a resistor R10 is connected to an end of a resistor R11 to constitute a series circuit consisting of the resistor R11 and a resistor R12. Further, to the junction between the resistor R11 and the resistor R12 is connected the noninverting input terminal (+) of the operational amplifier OP4. The electric potential of the power line LV is divided by the resistor R11 and the resistor R12 to produce a divided voltage which is inputted to the noninverting input terminal (+) of the operational amplifier OP4.

Further, to the junction between the resistor R10 and the inverting input terminal (−) of the operational amplifier OP4 is connected the emitter of the transistor Tr1.

Due to this, the operational amplifier OP4 outputs at the output terminal an electric potential corresponding to the difference in electric potential between the junction between the resistor R11 and the resistor R12 and the end of the resistor RIO connected to the inverting input terminal (−) of the operational amplifier OP4. Finally, the operational amplifier OP4 balances the electric potential at the junction between the resistor R11 and resistor R12 and the electric potential at the junction between the resistor RIO and the inverting input terminal (−) of the operational amplifier OP4 from each other so that the difference between them becomes 0 v (zero volt). Due to this, there is generated the flow of current from power line LV and through the emitter-base of the transistor Tr1 and the resistor R9, thus causing the transistor Tr1 to be put into an ON condition. When this is the case, the current flowing from the transistor Tr1 toward the switch SW2 takes a constant value which is determined by the respective resistance values of the resistors R9, R10, R11 and R12.

For this reason, the switch SW2 is put into an ON condition, thus causing the connecting path connecting between the transistor Tr1 and the capacitor C2 to be short-circuited. By this, a constant current flows into the capacitor C2 by way of the transistor Tr1 so that a charge is accumulated in the capacitor C2. In this instance, the amount of charge accumulated in the capacitor C2 is proportional to the length of time during which the switch SW2 is held in an ON condition.

The junction between the switch SW2 and the capacitor C2 is connected to the ECU 21 so that the potential difference between the opposite ends of the capacitor C2 which is generated in accordance with the charge accumulated in the capacitor C2, is supplied as a discharge current integration signal Sb to the ECU 21.

The calculating circuit 310 includes a resistor R8 with an end connected to the junction between the switch SW2 and the capacitor C2 and a switch SW3 for short-circuiting and disconnecting a connecting path connecting between the other end of the resistor R8 and the ground.

In the meantime, the switch SW2 is constructed similarly to the switch SW1 and has a switching portion inside thereof. When the voltage signal inputted to the input terminal of the switch SW2 is high in level (e.g., 5 v), the switching portion closes. When the voltage signal inputted to the input terminal is low in level (e.g., ground potential 0 v), the switching portion opens.

The switch SW3 has an input terminal connected to the ECU 21 to receive therefrom a calculation reset signal Sa. When the calculation reset signal Sa becomes high in level, the switch SW3 is put into an ON condition to short-circuit the connecting path. When the calculation reset signal Sa becomes low in level, the switch SW3 is put into an OFF condition to disconnect the connecting path. When the switch SW3 is put into an ON condition to short-circuit the connecting path, a closed loop consisting of the capacitor C2 and the resistor R8 is established to cause a current due to the charge accumulated in the capacitor C2 to flow through the closed loop, thus causing the capacitor C2 to be discharged as the time lapses.

As described above, in the calculating circuit 310 in the ignition system 100 of the fourth embodiment, when a discharge current of a predetermine current value or larger flows through the detection resistor 19 for thereby allowing the electric potential Vr to become equal to or larger than a predetermined value, the switch SW2 is put into an ON condition to cause a constant current to flow into the capacitor C2 by way of the transistor Tr1 and thereby charge the capacitor C2. The amount of charge accumulated in the capacitor C2 is proportional to the time during which the electric potential Vr is held equal to or above a predetermined value. The electric potential Vr is held equal to or above a predetermined value when the discharge current (secondary current i2) which is equal to or larger than the constant current is flowing. Accordingly, the potential difference proportional to the current detection time which is the period of time during which the flow of discharge current equal to or above a predetermined value is present, is generated between the opposite ends of the capacitor C2.

Accordingly, the calculating circuit 310 generates a signal representative of the potential difference between the opposite ends of the capacitor C2, as a detection time signal Sb and supplies it to the ECU 21.

On the other hand, when the ECU 21 causes the calculation reset signal Sa to become high in level, the switch SW3 is put into an ON condition to short-circuit the connecting path and constitute a closed loop consisting of the capacitor C2 and the resistor R8, thus causing a current to flow through the closed loop due to the charge accumulated in the capacitor C2. In this instance, due to the consumption of electric power at the resistor R8, the capacitor C2 is discharged. When the capacitor C2 is discharged completely, the voltage across the opposite ends of the capacitor C2 becomes 0 v (zero volt). By this, the current detection time stored inside the calculating circuit 310 is reset.

As described above, the ECU 21 in the ignition system 100 of the fourth embodiment does not calculate the current detection time by its internal processing but receives the detection time signal Sb determined by the calculating circuit 310 to derive the current detection time therefrom. That is, in the above described second embodiment, the current detection time is calculated by a partial process step of the fouling detection process which is an internal processing carried out within the ECU 21. In contrast to this, in the fourth embodiment, the current detection time is obtained by derivation by the use of the calculating circuit 310.

Then, the fouling detection process to be executed in the ECU 21 of the internal combustion engine ignition system 100 of the fourth embodiment will be described. In the meantime, the fouling detection process in the fourth embodiment is similar to that in the second embodiment in that detection of fouling is based on the current detection time but differs in the method of calculating the current detection time. Thus, modified steps of the flow chart of FIG. 6 (i.e., steps relating to steps S330 to S350, S390 and S420) will be described.

Firstly, in step S330 of the second embodiment, the time at this moment is stored for starting the calculation of the current detection time. In contrast to this, in the fourth embodiment, the calculating circuit 310 detects a variation of the electric potential Vr and starts calculating the current detection time. Thus, in step S330 of the fourth embodiment, there is not any processing to be executed.

In step S340 of the fourth embodiment, it is judged, similarly to the second embodiment, if the discharge current I is smaller than the current value criterion Ith. When the judgment in step S340 is Yes, the program proceeds to step S350. When the judgment is No, step S340 is repeated to wait until I <Ith.

When the discharge current I becomes smaller than the current value criterion Ith, i.e., the judgment in step S340 is Yes, the program proceeds to step S350. In step S350 in the second embodiment, by subtracting the time stored in step S330 from the time at this point of time, the current detection time is calculated. In the fourth embodiment, the calculating circuit 310 finishes the calculation of the current detection time in response to a variation of the electric potential Vr. Thus, in step S350 of the fourth embodiment, a processing for ending the calculating process is not executed. However, in step S350 of the fourth embodiment, it is executed such a processing of reading the detection time signal Sb outputted by the calculating circuit 310 and calculating the current detection time on the basis of the level of the detection time signal Sb (actually, the voltage across the opposite ends of the capacitor C2).

Thereafter, in steps S360 and onward, similar processing to the first embodiment is executed except for steps S390 and S420.

In step S390 of the fourth embodiment, the calculation reset signal Sa is changed to high in level, and the current detection time (actually, the amount of charge accumulated in the capacitor C2) stored in the calculating circuit 310 is reduced to 0 (zero) for thereby resetting the current detection time. After the processing at step S390 is executed, the program proceeds to step S320.

In step S420 of the fourth embodiment, a process for countermeasure against fouling such as one for outputting a fouling detecting signal and switching on an alarm lamp (not shown in FIG. 8) is performed, the calculation reset signal Sa is made high in level, and the current detection time kept inside the calculating circuit 310 (actually, the amount of charge accumulated in the capacitor C2) is updated to 0 (zero) for thereby resetting the current detection time. After execution of step S420, the program proceeds to step S320.

The spark plug fouling detection process of the fourth embodiment executes the above described steps from S320 to S420 repeatedly and detect the spark plug fouled condition on the basis of the current detection time calculated by the use of the calculating circuit 310.

Thus, the internal combustion engine ignition system 100 of the fourth embodiment detects the spark plug fouling on the basis of the current detection time similarly to the second embodiment and therefore can produce substantially the same effect as the second embodiment. Further, in the fouling detection process of the fourth embodiment, the current detection time is calculated by the use of the calculating circuit (analog circuit) 310, thus making it unnecessary for the ECU 21 to execute a current detection time calculating process and therefore making it possible to suppress increase in the processing load of the ECU 21 resulting from execution of internal processing. Accordingly, the load of the ECU 21 can be reduced or mitigated.

Although the invention has been described above by reference certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A method of detecting spark plug fouling in an internal combustion engine comprising:

detecting a discharge current flowing between electrodes of the spark plug when a high voltage for ignition is applied to the spark plug; and determining a fouled condition of the spark plug on the basis of the discharge current, wherein said detecting comprises integrating the discharge current during a period of a spark discharge of the spark plug, and said determining comprises judging if an integration value of the discharge current is larger than a criterion and judging that the sparkplug has been fouled when the integration value of the discharge current is equal to or smaller than the criterion.

2. A method of detecting spark plug fouling in an internal combustion engine comprising:

detecting a discharge current flowing between electrodes of the spark plug when a high voltage for ignition is applied to the spark plug; and determining a fouled condition of the spark plug on the basis of the discharge current, wherein said detecting comprises calculating a current detection time during which the discharge current during a period of a spark discharge of the spark plug is equal to or larger than a predetermined current value criterion, and said determining comprises judging if the current detection time is larger than a predetermined detection time criterion and judging that the sparkplug has been fouled when the current detection time is equal to or smaller than the detection time criterion.

3. A method of detecting spark plug fouling in an internal combustion engine having an ignition system that interrupts flow of primary current through a primary winding of an ignition coil and thereby inducing a high voltage for ignition in a secondary winding of ignition coil and applies the high voltage for ignition to a spark plug, the method comprising:

detecting across a detecting resistor a discharge current flowing between electrodes of the spark plug when the high voltage for ignition is applied to the spark plug; and determining a fouled condition of the spark plug on the basis of the discharge current.

4. A method according to claim 3, wherein said detecting comprises integrating the discharge current during a period of a spark discharge of the spark plug, and said determining comprises judging if an integration value of the discharge current is larger than a criterion and judging that the spark plug has been fouled when the integration value of the discharge current is equal to or smaller than the criterion.

5. A method according to claim 3, wherein said detecting comprises calculating a current detection time during which the discharge current during a period of a spark discharge of the spark plug is larger than a predetermined current value criterion, and said determining comprises judging if the current detection time is larger than a predetermined detection time criterion and judging that the spark plug has been fouled when the current detection time is equal to or smaller than the detection time criterion.

6. A method according to claim 3, wherein said detecting comprises using a detection resistor connected in series to a current path of the ignition system through which the discharge current flows, said resistor being of such a resistance value that enables the voltage which is applied across the electrodes of the spark plug when the high voltage for ignition is induced in the ignition coil, to be maintained above a voltage necessitated for generation of the spark discharge, and detecting the voltage across the opposite ends of the detection resistor.

7. A method according to claim 6, wherein the resistance value of said detection resistor ranges from 1Ω to 10 kΩ.

8. A method of detecting spark plug fouling in an internal combustion engine having an ignition system including an ignition coil having a primary winding and a secondary winding, a spark plug having a center electrode and a ground electrode, the center electrode being connected to an end of the secondary winding, and a resistor connected in series with the secondary winding and having an end connected to the other end of the secondary winding and another end grounded, the method comprising:

detecting a waveform of voltage across the resistor, which is caused when the ignition coil applies a high voltage to the spark plug for generation of a spark; and determining a fouled condition of the spark plug on the basis of the waveform of the voltage.

9. An ignition system for an internal combustion engine comprising:

an ignition coil having a primary winding and a secondary winding;

a spark plug having a pair of electrode and an insulator insulating between the electrodes; and a control unit that interrupts flow of primary current through said primary winding and thereby inducing a high voltage for ignition in said secondary winding;

wherein said control unit includes:

detecting means for detecting a discharge current flowing between the electrodes of said spark plug when the high voltage for ignition is applied to said spark plug; and judging means for judging if said spark plug has been fouled on the basis of the discharge current.

10. An ignition system according to claim 9, further comprising:

a current path through which said discharge current flows; and a detection resistor connected in series with said current path;

said detection resistor having such a resistance value that enables the voltage applied across the electrodes of said spark plug when the high voltage for ignition is induced in said secondary winding, to be maintained above a voltage necessitated for generation of the spark.

11. An ignition system according to claim 10, wherein the resistance value of said detection resistor ranges from 1Ω to 10 kΩ.

12. An ignition system according to claim 9, wherein said detecting means comprises a calculating circuit including a capacitor which is charged in proportion to an integration value of the discharge current.

13. An ignition system according to claim 9, wherein said detecting means comprises a calculating circuit including a capacitor which is charged in proportion to a time during which the discharge current during a period of a spark discharge of the spark plug is larger than a predetermined current value criterion.

* * * * *